United States Patent [19]

Budden et al.

[11] Patent Number: 4,602,784

[45] Date of Patent: Jul. 29, 1986

[54] EXERCISE CUFF

[76] Inventors: Brent R. Budden; Jo Anne E. Budden, both of 1000 Old Fort Rd., Klamath Falls, Oreg. 97601

[21] Appl. No.: 627,275

[22] Filed: Jul. 2, 1984

[51] Int. Cl.[4] ..... A63B 21/12

[52] U.S. Cl. ..... 272/119; 272/DIG. 9

[58] Field of Search ..... 272/95, 96, 119, DIG. 9; 128/402

[56] References Cited

U.S. PATENT DOCUMENTS

| | | | |
|---|---|---|---|
| 500,686 | 7/1893 | Corker | 272/119 X |
| 1,473,506 | 11/1923 | Nessler | 128/402 X |
| 2,720,656 | 10/1955 | Allan, Jr. | 272/119 X |
| 3,525,141 | 8/1970 | Smith | 272/119 X |
| 3,971,559 | 7/1976 | Diforte, Jr. | 273/26 B |
| 4,195,833 | 4/1980 | Svendson | 272/95 |
| 4,204,543 | 5/1980 | Henderson | 128/402 |
| 4,384,714 | 5/1983 | Kimura | 272/96 X |
| 4,462,116 | 7/1984 | Sanzone et al. | 272/119 X |

FOREIGN PATENT DOCUMENTS

| | | | |
|---|---|---|---|
| WO83/01201 | 4/1983 | PCT Int'l Appl. | 272/119 |

*Primary Examiner*—Robert A. Hafer
*Assistant Examiner*—Kathleen D'Arrigo
*Attorney, Agent, or Firm*—James D. Givnan, Jr.

[57] ABSTRACT

A tubular member of the cuff is of toroidal shape and of an elastic nature for retention on the user's wrist or ankle during exercising. A fabric exterior overlies a foam rubber component. The tubular member is charged with lead shot.

5 Claims, 5 Drawing Figures

EXERCISE CUFF

BACKGROUND OF THE INVENTION

The present invention concerns generally an attachment for the wrist or ankle to be worn during the performance of exercises.

The attachment of weights to the body appendages to increase muscular effort while exercising is considered to be beneficial. By so doing, increased physical exertion is achieved over exercising without such weights.

The known prior art includes U.S. Pat. No. 4,195,833 which discloses a weight provided exercise aid having stretch fabric; U.S. Pat. No. 4,036,491 which discloses a reducing belt; U.S. Pat. No. 2,720,656 which discloses a weight for holding clothing in place and having weights and a flexible covering.

SUMMARY OF THE PRESENT INVENTION

The present invention is embodied in an elastic cuff for wear on the ankle or wrist while exercising.

The present device includes a shell of an elastic nature within which is housed a discrete, high density material. The shell, accordingly, may expand during passage over the hand or foot and when in place on the wrist or ankle contracts to hug same and remain in place without hindering hand or foot circulation. The shell has an absorbent elastic fabric exterior. The weight material by its descrete nature permits expansion and contraction of the elastic shell.

Important objectives include a weighted exercise cuff for wear on the wrist or ankle and which is of an elastic nature to facilitate convenient installation and removal from the body; the provision of an elastic exercise cuff having an absorbent, padded member which contributes to convenient application over the hand or foot and comfortable wearing of same; the provision of an exercise cuff wherein seams may be both cemented and sewn to preclude the risk of separation.

DETAILED DESCRIPTION OF THE PREFERRED EMBODIMENT

Figure 1:
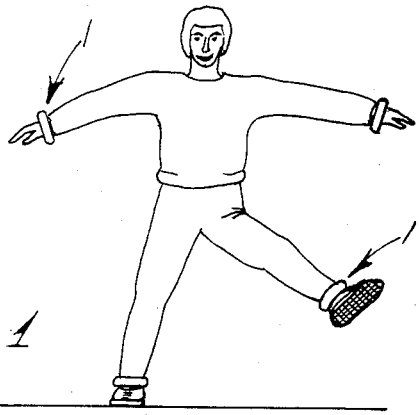
FIG. 1 is an elevational view of a person wearing the present exercise cuff on both wrists and ankles.
Figure 2:
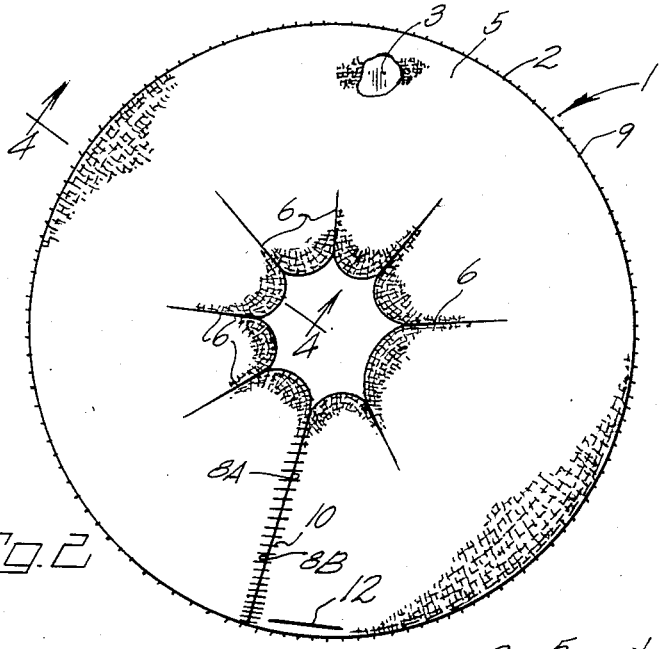
FIG. 2 is a plan view of the present exercise cuff.
Figure 3:
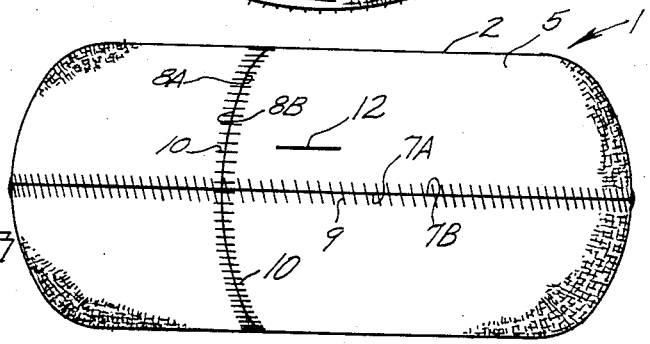
FIG. 3 is an elevational view of FIG. 2.
Figure 4:
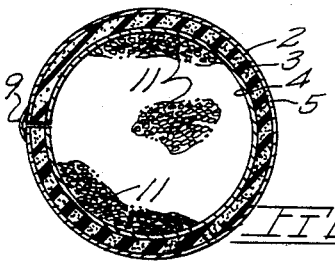
FIG. 4 is a vertical, sectional view taken along line 4—4 of FIG. 2.

With continuing attention to the drawing wherein applied reference numerals indicate parts similarly hereinafter identified, the reference numeral 1 indicates generally the present cuff which, as shown in FIG. 1, is of toroidal shape suitable for wear on the wrists and ankles during exercise.

The cuff includes an elastic toroidal member 2 of tubular construction. An elastomeric foam component is at 3. Inner and outer fabric surfaces of the cuff are at 4 and 5.

A suitable material for the construction of the cuff is that known in the trade as fabric backed, elastomeric neoprene foam of the type used in the manufacture of scuba divers' wet suits. The opposite sides of the elastomeric foam have an elastic fabric bonded thereto which yields or stretches in random directions. Accordingly, the cuff is capable of considerable expansive and contractive movement for convenient hand or foot passage yet gently closes about the wrist or ankle. Further, the fabric surface 5 facilitates slipping of the device over the wearer's skin with a minimum of friction. Generally radially extending folds in the cover are indicated at 6.

Figure 5:
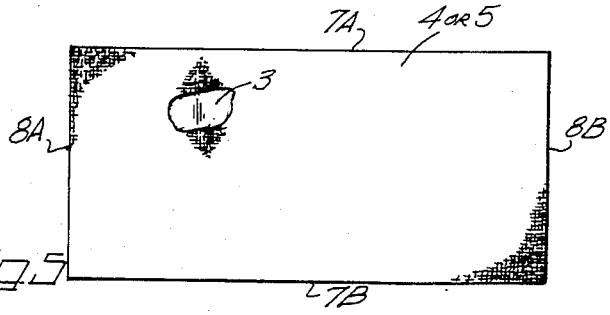
FIG. 5 is a plan view of a rectangular piece of fabric prior to shapeing and sewing of same into a circular shape.

With reference to FIG. 5, a piece of fabric backed, open cell foam material has long side edges 7A-7B, short end edges at 8A-8B. A circular course of stitching at 9 on the cuffs outer periphery joins side edges 7A-7B while radially disposed stitching 10 joins end edges 8A-8B.

A discrete filler for the cuff is metal shot at 11 such as lead shot. A suitable weight for an exercise cuff to be used on the wrist is one and one-half pounds, while the exercise cuff for the ankle is two and one-half pounds. For rapid filling of the cuff, a slit 12 receives an air evacuation nozzle which is combined with a shot discharge nozzle which function simultaneously. Slit 12 is then glued.

The edges 7A-7B and 8A-8B are both glued and blindstitched to seal the cuff and prevent the loss of the shot filler. Number eight size lead shot serves as a suitable filler.

While we have shown but one embodiment of the invention it will be apparent to those skilled in the art that the invention may be embodied still otherwise without departing from the spirit and scope of the invention.

Having thus described the invention, what is desired to be secured under a Letters Patent is:

1. A weighted cuff for wear on a wrist or ankle during exercising, said cuff comprising, a continuous elastic member of toroidal shape, said member being of tubular construction, a filler of high density discrete particulate material occupying the interior of said member, and said continuous elastic member fully occupied by said filler.

2. The cuff claimed in claim 1 wherein said continuous elastic member includes an elastic fabric surface on its exterior.

3. The cuff claimed in claim 2 wherein said elastic member is fabric covered neoprene foam which serves to cushion cuff induced forces during exercising.

4. The cuff claimed in claim 2 wherein said continuous member is confined in a toroidal shape by radially disposed stitching and an adhesive.

5. The cuff claimed in claim 4 wherein said continuous elastic member is additionally stitched about its outer periphery to thereby locate stitching away from the user's skin.

* * * * *